United States Patent [19]

Goubaud

[11] Patent Number: 4,629,355

[45] Date of Patent: Dec. 16, 1986

[54] DEVICE FOR ATTACHING A SCAFFOLDING BRACKET TO A FRAME MEMBER, AND FIXING ASSEMBLY FOR IMPLEMENTING SAME

[75] Inventor: Michel Goubaud, Ancenis, France

[73] Assignee: Dimos Batiment Distribution de Materiel Outillage et Securite pour le Batiment, Ancenis, France

[21] Appl. No.: 716,157

[22] Filed: Mar. 26, 1985

[30] Foreign Application Priority Data

Apr. 3, 1984 [FR] France ..... 84 05217

[51] Int. Cl.[4] ..... B25G 3/36; E04G 7/00

[52] U.S. Cl. ..... 403/389; 248/231.3

[58] Field of Search ..... 403/389, 390, 386; 248/231.3, 235

[56] References Cited

U.S. PATENT DOCUMENTS 3,190,601 6/1965 Williams ..... 248/231.3
3,954,248 5/1976 Barber ..... 248/235 X

FOREIGN PATENT DOCUMENTS 3224525 1/1984 Fed. Rep. of Germany .
2245213 4/1975 France .
8400482 1/1984 France .
8500702 1/1985 United Kingdom .

*Primary Examiner*—Andrew V. Kundrat
*Attorney, Agent, or Firm*—Charles E. Brown; Charles A. Brown

[57] ABSTRACT

A device for attaching a scaffolding bracket to a frame member such as a rafter comprises two flanges adapted to be disposed one on each side of the frame member. Fixing means are adapted to fasten the flanges to the frame member and attachment means are associated with the flanges to enable a scaffolding bracket to be coupled to them. The fixing means comprise two grooved rollers and a common clamping spindle member on which the grooved rollers are engaged. The rollers lie one on each side of the frame member, against its side surfaces. A bearing member adapted to bear on the edge of the frame member is disposed between the flanges and interlocked with both of them in at least the direction transverse to the clamping spindle member. Each flange comprises, spaced from the bearing member, a keyhole slot whereby each may be engaged upon a respective one of the grooved rollers, with the edge of the keyhole slot engaged in the groove on the roller.

20 Claims, 8 Drawing Figures

DEVICE FOR ATTACHING A SCAFFOLDING BRACKET TO A FRAME MEMBER, AND FIXING ASSEMBLY FOR IMPLEMENTING SAME

BACKGROUND OF THE INVENTION

1. Field of the Invention

The present invention is generally concerned with attaching a scaffolding bracket to a frame member of any kind, more often than not in practice a rafter.

It is more particularly directed to the case where, for the purposes of such attachment, use is made of two flanges adapted to be disposed one on each side of the frame member concerned, fixing means adapted to fasten said flanges to the frame member and attachment means associated with said flanges adapted to enable a scaffolding bracket to be coupled to them.

2. Description of the Prior Art

In a presently known device of this type, the fixing means employed to fasten flanges of this kind to a rafter comprise a plurality of clamping spindle members of the nut-and-bolt type, two in number in practice, and attachment means associated with said flanges to enable a scaffolding bracket to be coupled to them employ two pegs independently fastened to respective flanges on a part of the latter transversely offset for this purpose relative to its main part.

A device of this kind has various disadvantages.

Firstly, the multiplicity of clamping spindle members to be employed requires that the same number of holes be bored in the frame member to be equipped, to the detriment of its integrity and prejudicial in terms of the number of operations to be executed when fitting the flanges concerned and when removing them.

Also, in spite of their number, the clamping spindle members thus employed, which in practice merely apply the flanges between them against the frame member, may prove insufficient for it to be certain that all aspects of applicable safety standards can be adhered to, in certain countries at least.

Finally, the attachment pegs project cantilever fashion independently from the flange to which they are fitted and it is not uncommon to find these deforming under load, unless the thickness of the flanges is made prohibitive.

A general object of the present invention is an arrangement which, adapted to attach a scaffolding bracket to a frame member of any kind, in practice a rafter, is advantageously free of these disadvantages and further confers other advantages.

SUMMARY OF THE INVENTION

In one aspect, the invention consists in a device for attaching a scaffolding bracket to a frame member such as a rafter, comprising two flanges adapted to be disposed one on each side of said frame member, fixing means adapted to fasten said flanges to said frame member, and attachment means associated with said flanges adapted to enable a scaffolding bracket to be coupled to them, wherein said fixing means comprise two grooved rollers and a common clamping spindle member on which said grooved rollers are engaged so as to lie one on each side of said frame member, against the side surfaces thereof, a bearing member adpated to bear on the edge of said frame member, disposed between said flanges and interlocking with both of them in at least the direction transverse to said clamping spindle member, and wherein each of said flanges comprises, spaced from said bearing member, a keyhole slot whereby each may be engaged upon a respective one of said grooved rollers with the edges of said keyhole slot engaged in the groove in said roller.

In another aspect, the invention consists in a fixing assembly for implementing a device as defined in the preceding paragraph, comprising a clamping spindle member and two grooved rollers adapted to be disposed on said clamping spindle member with one on each side of said frame member.

Thus, in accordance with the invention, a single clamping spindle member is used, which advantageously simplifies the mounting and demounting operations.

In practice, in accordance with the invention, in addition to the grooved rollers there are engaged on the clamping spindle member two dogs or claw washers disposed between the grooved rollers so that their respective claws are directed towards one another in order to penetrate said frame member.

In conjunction with the associated bearing member, which transmits to another point on the frame member at least part of the load to be absorbed by the latter, moreover developing under compression this part of said load, the dogs thus employed offer the advantage of satisfying without difficulty the most severe applicable safety standards, by virtue of being embedded in the frame member to a relatively great depth.

The attachment means employed to permit a scaffolding bracket to be coupled to the flanges fixed in this manner conjointly comprise, inter alia, a crossmember adapted to extend transversely from one of the flanges to the other, perpendicular to them.

A crossmember of this kind may be carried unitary construction fashion on one of the flanges, for example, to which it is perpendicular, the other flange featuring an opening complementary to the transverse cross-section of the crossmember so that it may be engaged over the latter.

Alternatively, it may be formed by two half-members each fast with a respective one of said flanges and adapted to be interlocked with one another between the latter.

Be this has it may, when under load a crossmember of this kind, which is of course made resistant to bending, offers the advantage of ensuring that both flanges are operative simultaneously, without any cantilever-fashion type load being exerted on them of a kind likely to deform them.

In practice, for the purpose of using a crossmember of this kind benefit is drawn from the fact that, for the same hold, only part of the flanges of the device in accordance with the invention flanks the frame member concerned, whereby a significant part of the flanges can extend above a frame member and thus be used to mount the crossmember.

Further exploiting this arrangement, the attachment means employed to couple a scaffolding bracket to the flanges may additionally comprise, if required, in addition to or instead of the aforementioned crossmember, two notches similarly formed in said flanges, in corresponding relationship to one another when in use, with a concave side directed away from the associated bearing member.

Notches of this kind offer the advantage of permitting the fitting of a crossmember extending freely from one of the flanges to the other, and said crossmember (which may of course be employed to attach a scaffolding bracket in line with the frame member concerned) may also, if required, provide for the attachment of a scaffolding bracket of this kind between two such frame members, by virtue of its extending from one frame member to another.

In this way it is possible to mount scaffolding brackets at an interval different to that of the frame members equipped with the necessary attachment devices.

Finally, the attacment device in accordance with the invention is particularly simple and economic to make and fit.

Other objects and advantages will appear from the following description of examples of the invention, when considered in connection with the accompanying drawings, and the novel features will be particularly pointed out in the appended claims.

DESCRIPTION OF THE PREFERRED EMBODIMENTS

Figure 1:
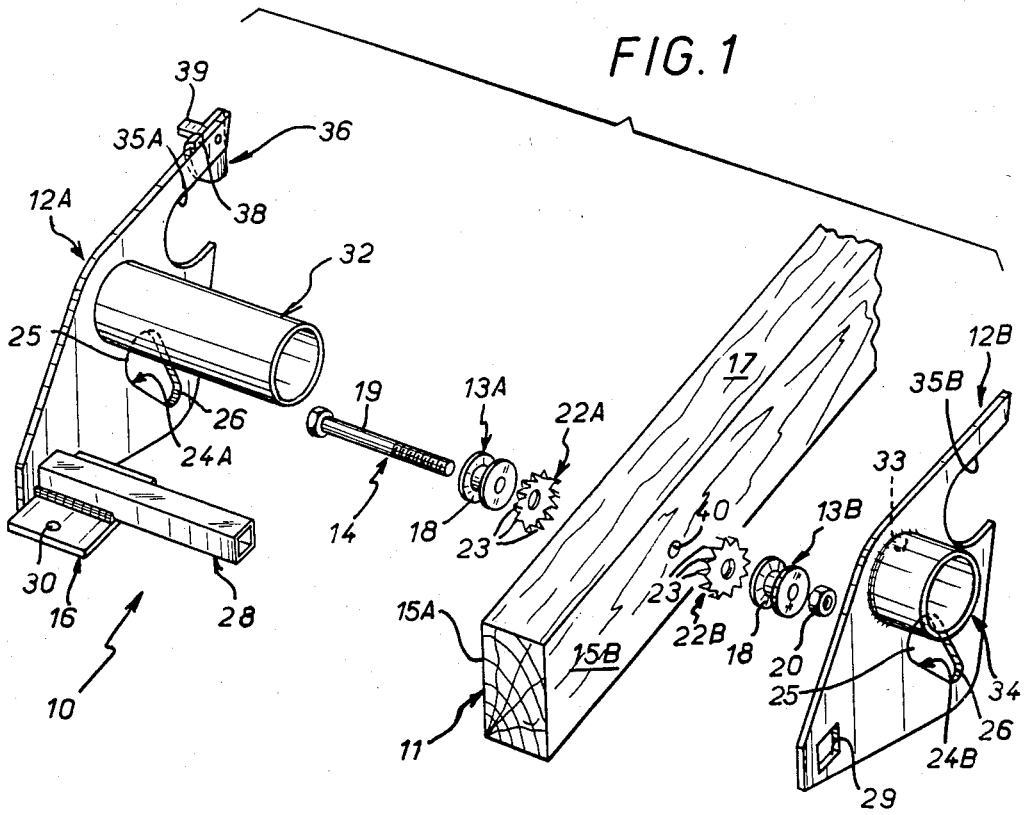
FIG. 1 is an exploded view in perspective of an attachment device in accordance with the invention, shown in association with part of a frame member to which it is to be fitted.

As shown in these figures, the attachment device 10 in accordance with the invention comprises, in a manner which is known per se, for attaching a scaffolding bracket (not shown) to a frame member, in practice a rafter 11, two flanges 12A, 12B adapted to be disposed one on each side of a rafter 11 of this kind, fixing means, to be described in detail hereinafter, adapted to fasten said flanges 12A, 12B to the rafter, and attachment means, also to be described in detail hereinafter, associated with said flanges 12A, 12B and adapted to permit a scaffolding bracket of this kind to be coupled to them.

In accordance with the invention, the fixing means designed to fasten the flanges 12A, 12B to the rafter 11 comprise, in combination, on the one hand, two grooved rollers 13A, 13B which, engaged on a common clamping spindle member 14, are designed to be applied to the lateral surfaces 15A, 15B of the rafter 11 to be equipped, being disposed one on each side of the latter, and, operative between the flanges 12A, 12B and interlocked with both of the latter, in at least the direction transverse to said clamping spindle member 14, these arrangements to be described in more detail hereinafter, a bearing member 16 adapted to bear on the edge, in practice the top edge 17, of a rafter 11 of this kind.

By the term "grooved roller" (13A, 13B) there is meant in this context a roller of which the peripheral cylindrical surface has a groove 18 formed in its median area.

In the embodiments shown this groove 18 has a trapezoidal profile in axial cross-section, converging from the outside towards the inside, but other profiles may be appropriate, specifically a rectangular profile.

Be this as it may, the width of the bottom of a groove 18 of this kind, as measured in the axial direction, must be at least equal to the thickness of the flanges 12A, 12B.

In a manner known per se the clamping spindle member 14 consists of a bolt 19 and a nut 20.

In accordance with the invention there are engaged on this clamping spindle member 14, in addition to the previously described grooved rollers 13A, 13B, two clawed washers 22A, 22B disposed between said grooved rollers 13A, 13B the claws 23 of which are directed towards one another, in order to penetrate into the rafter 11 by biting into it.

Such clawed washers 22A, 22B are well known per se, to carpenters in particular, by the name safety dogs, for example, and as they do not of themselves constitute part of the present invention, they will not be described in detail here.

It will suffice to indicate that, in the usual manner, their claws 23 (or teeth) extend perpendicular to their plane, being regularly distributed in the circumferential direction around their perimeter.

In the embodiments shown, these claws 23 have a triangular overall shape.

For the purpose of engaging them over the grooved rollers 13A, 13B each of the flanges 12A, 12B comprises, at a distance from the bearing member 16, a keyhole slot 24A, 24B.

In practice, a keyhole slot 24A, 24B of this kind has a generally ovoid contour to permit its axial engagement over the grooved roller 13A, 13B concerned at its end 25 with the relatively greater radius of curvature, which is greater than that of the outside contour of the grooved roller 13A, 13B, and its engagement with the groove 18 in said roller 13A, 13B at its end 26 with a relatively lesser radius of curvature, which is intermediate that of said contour and that of the bottom of said groove 18.

In the embodiments shown, the bearing member 16 is fast with a crossmember 28 adapted to extend transversly from one of the flanges 12A, 12B to the other.

In practice, in these embodiments, this crossmember 28 is carried unitary construction fashion by one of the flanges 12A, 12B, in this instance the flange 12A, to which it is perpendicular, and for the purpose of engaging it over this crossmember 28 the other of said flanges 12A, 12B, in this instance the flange 12B, features an opening 29 the contour of which is complementary to the transverse cross-section of the crossmember.

In the embodiments shown, this transverse cross-section is polygonal and in practice square.

The bearing member 16, which in these embodiments merely consists of a rectangular plate, is attached to the bottom surface of the crossmember 28, as by welding, for example, possibly with one of its edges contiguous with the flange 12A, and said crossmember 28 is itself attached to the latter, as by welding, for example.

For example, and as shown here, the bearing member 16 features at least one hole 30 for any kind of fixing means for fastening it to the rafter 11, such as a nail, for example.

In accordance with the invention, the attachment means associated with the flanges 12A, 12B to permit a scaffolding bracket to be coupled to them also comprise a crossmember adapted to extend from one of the flanges 12A, 12B to the other.

In the embodiment specifically shown in FIGS. 1 through 6, this is a crossmember 32 separate from the foregoing crossmember 28.

Like the latter, however, in this embodiment this crossmember 32 is carried unitary construction fashion by one of the flanges 12A, 12B, in this instance the flange 12A and thus the same one as that carrying the crossmember 28, and for the purpose of its engagement over the crossmember 32, the other of said flanges 12A, 12B, in this instance the flange 12B, features an opening 33, the contour of which is complementary to the transverse cross-section of the crossmember.

In practice, in the embodiment shown, this transverse cross-section is circular and the crossmember 32 consists of a section of tube appropriately attached, as by welding, for example, to the flange 12A, to which it is perpendicular.

Preferably, and as shown here, the corresponding opening 33 in the flange 12B is bordered on its side opposite the flange 12A by a guide sleeve 34 perpendicular to the plane of the flange 12B.

Finally, in the embodiment specifically shown in FIGS. 1 through 6, the attachment means associated with the flanges 12A, 12B to permit a scaffolding bracket to be coupled to them further comprise two notches 35A, 35B formed in like manner in the respective flanges 12A, 12B, in corresponding relationship to one another when in use, with their concave side directed away from the associated bearing member 16.

Figure 5:
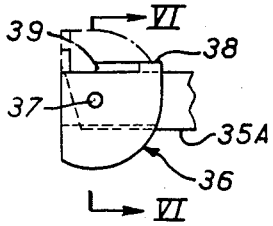
FIG. 5 is a partial view in elevation of the attachment device in accordance with the invention as seen in the direction of the arrow V in FIG. 2.
Figure 6:
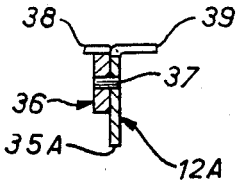
FIG. 6 is a partial view of it in transverse cross-section on the line VI—VI in FIG. 5.

For preference, and as shown here, there is associated with the border of at least the notch 35A in the flange 12A a retaining member 36 pivoted to said flange 12A on a pin 37, so that it is movable between a retaining position, shown in full line in the figures, in which it obtrudes into the internal contour of said notch 35A, and an insertion/withdrawal position, shown in chain-dotted line in FIG. 5, in which it lies wholly outside this contour.

In practice, in the embodiment shown, this retaining member 36 is merely a plate of which one edge is overall a quarter-circle and the other two edges at are right angles to one another.

To hold it in the retaining position this plate features a lip 38 perpendicular to its plane along one of its orthogonal edges, through which it is adapted to bear on the corresponding edge of the flange 12A, and it features along this same edge, and also perpendicular to its plane but in the direction opposite to the aforementioned lip 38, a lug 39 for manipulating it.

For fitting the attachment device 10 thus constituted it is merely necessary to drill a transverse hole 40 in the rafter 11 for the clamping spindle member 14 to pass through.

After the latter is fitted, together with its dogs 22A, 22B and its grooved rollers 13A, 13B, and the assembly has been clamped up by means of the nut 20, it is merely necessary to offer up the flanges 12A, 12B in corresponding relationship to one another, one on each side of the rafter 11.

As the flanges 12A, 12B are brought towards one another, the crossmembers 28, 32 carried by the flange 12A engage in the corresponding openings 29, 33 in the flange 12B, above the top edge 17 of the rafter 11.

The movement towards one another of the flanges 12A, 12B is continued until the end 25 having the relatively greater radius of curvature of the keyhole slots 24A, 24B in the flanges 12A, 12B engages over the grooved rollers 13A, 13B carried by the clamping spindle member 14.

As will be readily understood, during such relative movement towards one another of the flanges 12A, 12B, the guide sleeve 34 facilitates the displacement of the flange 12B relative to the flange 12A, preventing the flange 12B jamming on the crossmember 32 and/or the crossmember 28 carried by the flange 12A as a result of tilting around an axis in its own plane.

Figure 2:
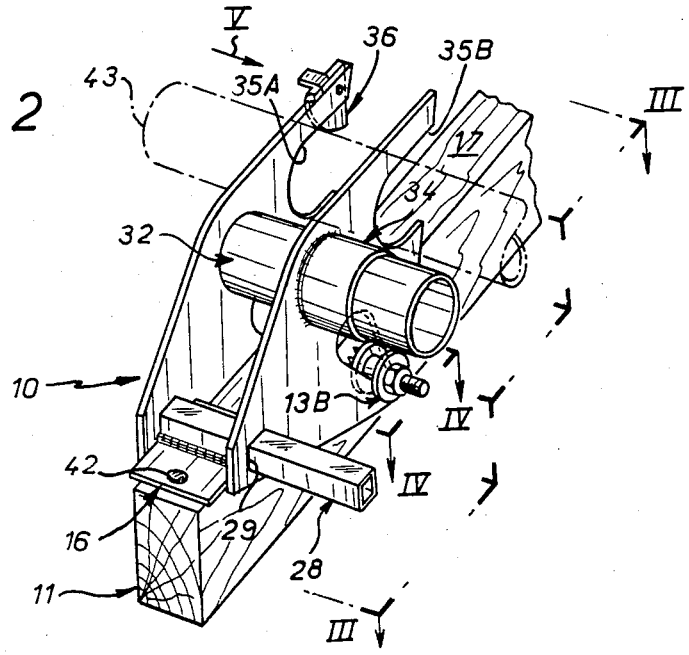
FIG. 2 is a perspective view of it in place on this frame member.
Figure 3:
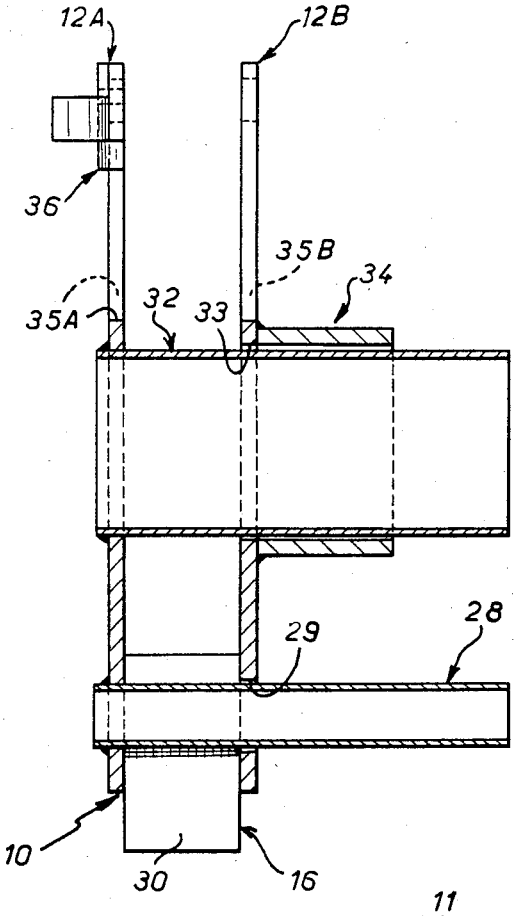
FIG. 3 is a view of it to a larger scale, partly in plan and partly in transverse cross-section on the broken line III—III in FIG. 2, without the frame member concerned.
Figure 4:
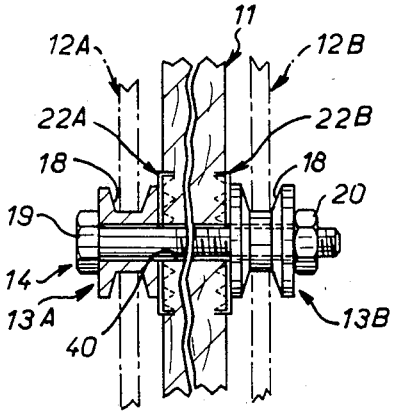
FIG. 4 is a view to the same scale as figure 3, partly in elevation and partly in axial cross-section on the line IV—IV in FIG. 2, showing in isolation the clamping spindle member employed in the attachment device in accordance with the invention with the grooved rollers and dogs which are associated with it in place on the frame member concerned.

When the flanges 12A, 12B are engaged over the grooved rollers 13A, 13B by virtue of their keyhole slots 24A, 24B, it is merely necessary to tilt them about the associated bearing member 16 until the edges of the keyhole slots 24A, 24B come into engagement with the groove 18 in the rollers 13A, 13B (FIG. 2).

In practice, given that rafters are usually sloping by their very nature, such tilting occurs of itself, due to gravity, and on its completion the attachment device 10 in accordance with the invention is fastened to the rafter 11 to which it is fitted by the clamping spindle member 14 and bears on the upper edge 17 of the rafter 11 through its bearing member 16.

As a safety measure, to avoid unwanted retrograde tilting of the attachment device 10, its bearing member 16 is preferably fastened to the rafter 11, however, using a nail 42 driven through the hole 30 which it comprises for this purpose, for example.

It is then possible to attach any form of scaffolding bracket to the crossmember 32, for example a scaffolding bracket of the type described in French patent application No. 84 00482 filed Jan. 13, 1984, provided that the scaffolding bracket is equipped with means appropriate to such attachment, as is the case in the aforementioned patent application.

In the foregoing, it is assumed that the scaffolding bracket concerned is fitted in line with the rafter 11, between the flanges 12A, 12B of the device 10 provided to this end.

As an alternative, it may be fitted between such rafters, however.

It is merely necessary to fit each rafter with an attachment device 10 and to install between these a crossmember 43 which, as shown in chain-dotted line in FIG. 2, extends freely from one flange 12A, 12B of an attachment device 10 of this kind to the other, by virture of engagement in the notches 35A, 35B provided to this end in the latter, and which is naturally itself able to have a scaffolding bracket attached to it at any point.

When fitting a crossmember 43 of this kind, the retaining member 36 of each of the attachment devices 10 concerned rotates of its own accord to the insertion position, and it is thereafter merely necessary to return it to the retaining position.

Thus in service a retaining member 36 of this kind is not in practice subject to any load, the crossmember 43 bearing under its own weight of the bottom of the notches 35A, 35B in which it is engaged and thus exerting no force on a retaining member 36 of this kind; in practice, the latter has only a safety function.

Figure 7:
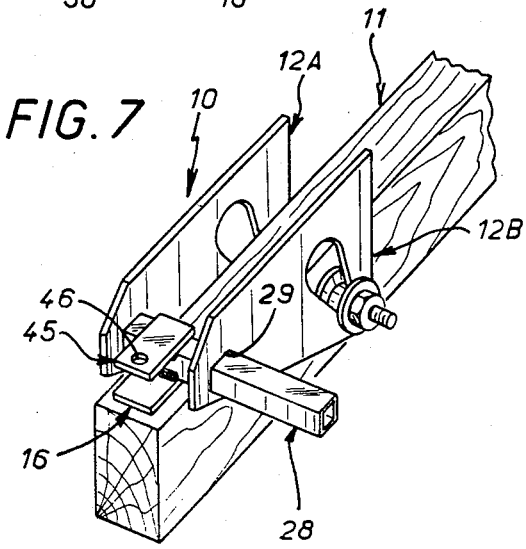
FIG. 7 is a perspective view analogous to that of FIG. 2, relating to an alternative embodiment of the attachment device in accordance with the invention.

In the embodiment shown in FIG. 7, the same crossmember 28 carries the bearing member 16 and the attachment means adapted to permit a scaffolding bracket to be coupled to the attachment device 10 concerned.

In this instance, these means consist in a plate 45 adapted to permit the attachment of a scaffolding bracket of the type described, for example, in French patent application No. 73 28767 filed Aug. 7, 1973 and published under No. 2.245.213.

This plate features a hole 46, which may be keyhole-shaped, to be engaged by a hook which a scaffolding bracket of this kind comprises.

As will be noted, in this embodiment the plate constituting the bearing member 16 and the plate 45 described hereinabove are both attached, as by welding, for example, to the crossmember 28, to respective opposite sides of the latter, for example.

In practice, the plate 45 then projects cantilever-fashion towards the front, relative to the crossmember 28, and as the bearing member 16 projects on each side of the crossmember 28 the hole 30 which is provided in it for fastening it to the rafter 11 concerned is formed in that of its ends projecting on the side opposite that on which the plate 45 projects.

In the foregoing, the crossmember or crossmembers which the attachment device 10 in accordance with the invention comprises is or are carried unitary construction fashion by one of the flanges of the latter.

Figure 8:
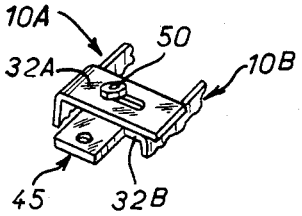
FIG. 8 is a partial view in perspective analogous to that of FIG. 2 relating to an alternative embodiment of the attachment device in accordance with the invention.

Alternatively, and as shown in FIG. 8 which relates to the crossmember 32, for example, a crossmember of this kind may be formed by two half-members 32A, 32B each fast with a respective one of the flanges 12A, 12B and adapted to be interlocked with one another, as by a bolt 50, for example. One of them, the half-member 32A, for example, features a slot for a bolt of this kind to pass through, so as to provide for adjustment of the gap in the assembly to the width of the rafter to be equipped.

In the embodiment shown, the other half-member 32B further constitutes the plate 45 provided to permit the attachment of a scaffolding bracket, by virtue of the arrangements described with reference to FIG. 7.

It will be understood that various changes in the details, materials and arrangements of part which have been herein described and illustrated in order to explain the nature of the invention may be made by those skilled in the art within the principle and scope of the invention as expressed in the appended claims.

For example, although in the foregoing the grooved rollers have both been shown as parts separate from the clamping spindle member on which they are engaged, at least one of them could be fastened to the clamping spindle member.

Also, a grooved roller of this kind could be reduced to a simple groove machined appropriately into the clamping spindle member, assuming that the latter were of sufficient diameter.

In all cases, and as will have been understood, the fixing assembly thus formed by a clamping spindle member and two grooved rollers engaged on the clamping spindle member or formed by it may advantageously be fitted permanently to any form of frame member, the remainder of the attachment device to whose use it contributes being, to the contrary, fitted to it only as and when necessary.

This fixing assembly thus of itself constitutes an accessory item which can be sold individually.

Also, when two separate crossmembers are employed, each of the openings by means of which a flange may be engaged over a crossmember of this kind may be bordered by a guide sleeve, and/or said crossmembers carried by respective different flanges.

In all cases they may have any suitable transverse cross-section.

Finally, it will be noted that, in accordance with one characteristic of the invention, the flanges constituting the attachment device in accordance with the invention are no necessarily applied against the frame member to which they are fitted and that, to the contrary, in the embodiments described and shown they are both slightly spaced from the latter, by a distance essentially equal to the thickness of one fo the flanks of the grooved rollers employed.

There is claimed:

1. Device for attaching a scaffolding bracket to a frame member having side surfaces and an edge such as a rafter, said device comprising two flanges adapted to be disposed one on each side of a frame member, fixing means for fastening said flanges to a frame member, and attachment means associated with said flanges for enabling a scaffolding bracket to be coupled to said flanges, wherein said fixing means comprise a clamping spindle member adapted to be mounted on a frame member and two grooved rollers engaged on said clamping spindle member so as to lie on opposite sides of a frame member against frame member side surface, a bearing member connected to each one of said flanges and engageable with a frame member edge such that said flanges are adapted to bear against a frame member edge through said bearing member, and each of said flanges having, spaced from said bearing member, an edge defining a keyhole slot, each of said keyhole slots having seated therein a respective one of said grooved rollers, with the edges of said flanges defining said keyhole slots being engaged in the grooves on the respective rollers.

2. Device according to claim 1, wherein said keyhole slot in each of said flanges is of generally ovoid shape, having an end of relatively greater radius of curvature and an end of relatively lesser radius of curvature, to permit its axial engagement over said grooved roller at said end with the relatively greater radius of curvature, which is greater than that of the outside contour of said grooved roller, and its engagement with the groove in said roller at said end with the relatively lesser radius of curvature, which is intermediate that of said outside contour and that of said groove.

3. Device according to claim 1, further comprising two claw washers engaged on said clamping spindle member between said grooved rollers so that their respective claws are directed towards one another in order to penetrate a frame member.

4. Device according to claim 1, wherein said bearing member is fast with a crossmember adapted to extend transversely from one of said flanges to the other.

5. Device according to claim 4, wherein said crossmember is carried by one of said flanges, to which it is perpendicular, and the other of said flanges features an opening the contour of which is complementary to the transverse cross-section of said crossmember, whereby it may be engaged upon said crossmember, whereby it may be engaged upon said crossmember.

6. Device according to claim 4, wherein the transverse cross-section of said crossmember is polygonal.

7. Device according to claim 1, wherein said bearing member is a plate.

8. Device according to claim 1, wherein said bearing member features at least one hole for fixing means for fastening said bearing member to a frame member.

9. Device according to claim 1, wherein said attachment means comprise a crossmember adapted to extend from one of said flanges to the other.

10. Device according to claim 9, wherein said crossmember is carried by one of said flanges, of which it is perpendicular, and the other of said flanges features an opening the contour of which is complementary to the transverse cross-section of said crossmember, whereby it may be engaged upon said crossmember.

11. Device according to claim 10, wherein the transverse cross-section of said crossmember is circular.

12. Device according to claim 5, wherein at least one of said openings which one of said flanges features to permit it to be engaged over a crossmember carried by the other of said flanges is bordered by a guide sleeve perpendicular to the plane of said one flange.

13. Device according to claim 10, wherein at least one of said openings which one of said flanges features to permit it to be engaged over a crossmember carried by the other of said flanges is bordered by a guide sleeve perpendicular to the plane of said one flange.

14. Device according to claim 4, wherein said crossmember is formed by two half-members each of which is fast with a respective one of said flanges and which are adapted to be interlocked with one another.

15. Device according to claim 9, wherein said crossmember is formed by two half-members each of which is fast with a respective one of said flanges and which are adapted to be interlocked with one another.

16. Device according to 1, wherein, for the purpose of fitting a crossmember extending freely from one of said flanges to the other, said attachment means comprise two notches, one in each of said flanges and in corresponding relationship to one another when in use, having a concave side directed away from the associated bearing member.

17. Device according to claim 16, further comprising a respective retaining member associated with the edge of at least one of said notches and adapted to pivot between a retaining position in which it obtrudes into the inside contour of a lateral projection of said at least one notch and an insert/withdrawal position in which it lies wholly outside of the lateral projection of said contour.

18. Fixing assembly for implementing a device for attaching a scaffolding bracket to a frame member having oppositely facing sides and an edge such as a rafter, said assembly comprising two flanges adapted to be disposed one on each side of a frame member, fixing means for fastening said flanges to a frame member, and attachment means associated with said flanges for enabling a scaffolding bracket to be coupled to said flanges, said fixing means comprising a clamping spindle member adapted to be mounted on a frame member and two grooved rollers engaged on said clamping spindle member so as to lie one on each side of a frame member, against a respective frame member side surface, a bearing member adapted to be connected to each one of said flanges and being engageable with a frame member edge such that said flanges are adapted to bear against a frame member edge through said bearing member, and each of said flanges having, spaced from said bearing member, an edge defining a keyhole slot, each of said keyhole slots having seated therein a respective one of said grooved rollers, with the edges of said flanges defining said keyhole slots being engaged in the grooves on the respective rollers.

19. Assembly according to claim 18, further comprising two claw washers engaged on said clamping spindle member between said grooved rollers so that their respective claws are directed towards one another in order to penetrate a frame member.

20. In a device for attaching a scaffolding bracket to a frame member having oppositely facing side surfaces and an edge such as a rafter, said device including two flanges adapted to be disposed one on each side of a frame member, attachment means associated with said flanges for enabling a scaffolding bracket to be coupled to said flanges, each of said flanges having edges defining a keyhole slot, a bearing member connected to each one of said flanges and engageable with a frame member edge such that said flanges are adapted to bear against a frame member through said bearing member;

the improvement in the form of fixing means for fastening said flanges to a frame member, said fixing means comprising a clamping spindle member adapted to be mounted on a frame member, and two grooved rollers engaged on said clamping spindle member so as to lie on respective sides of a frame member, against frame member side surfaces, said keyhole slots of the respective flanges being adapted to receive respective ones of said grooved rollers with said flange edges being engaged in the grooves of the rollers.

* * * * *